US005181974A

United States Patent [19]

Tanabe et al.

[11] Patent Number: 5,181,974

[45] Date of Patent: Jan. 26, 1993

[54] AUTOMOBILE BODY REINFORCING STEEL PIPE

[75] Inventors: Hiroto Tanabe; Kazumasa Yamazaki, both of Tokai, Japan

[73] Assignee: Nippon Steel Corporation, Tokyo, Japan

[21] Appl. No.: 796,768

[22] Filed: Nov. 25, 1991

[51] Int. Cl.[5] ..... C22C 38/04; C22C 38/14

[52] U.S. Cl. ..... 148/320; 148/909; 296/188; 49/502; 138/171

[58] Field of Search ..... 296/188, 146; 49/502; 138/171; 148/909, 320

[56] References Cited

U.S. PATENT DOCUMENTS 3,656,917 4/1972 Kikkawa et al. ..... 148/909
4,495,003 1/1985 Kubo ..... 148/909

FOREIGN PATENT DOCUMENTS 205828 12/1986 European Pat. Off. ..... 148/320
267895 5/1988 European Pat. Off. ..... 296/188
56-46538 11/1981 Japan .

*Primary Examiner*—Deborah Yee
*Attorney, Agent, or Firm*—Kenyon & Kenyon

[57] ABSTRACT

An automobile body reinforcing steel pipe having a wall thickness-to-outer diameter ratio, t/D, defined by:

$$0.09-4.8\times10^{-5}\times L \leqq t/D \leqq 0.16-6.0\times10^{-5}\times L$$

where L(mm) is a span of a bending load applied to the pipe. The pipe has a tensile strength of 120 kgf/mm$^2$ or more and an elongation of 10% or more, and is preferably made of a steel consisting of 0.15–0.25 wt % C, 1.8 wt % or less Mn, 0.5 wt % or less Si, 0.04 wt % or less Ti, 0.0003–0.0035 wt % B, and the balance of Fe and unavoidable impurities including 0.0080 wt % or less N. A process for producing the steel pipe comprises: coiling a hot rolled steel sheet at a temperature of 600° C. or higher; electric welding the adjoining edges of the sheet to form a steel pipe; and quench hardening the pipe.

4 Claims, 6 Drawing Sheets

AUTOMOBILE BODY REINFORCING STEEL PIPE

BACKGROUND OF THE INVENTION

1. Field of the Invention

The present invention relates to a high strength steel pipe, more particularly, to a steel pipe for reinforcing an automobile body when used, for example, as door impact bars for reinforcing automobile doors to ensure the driver's safety in a side collision, bumper cores, and other members requiring a tensile strength of 120 kgf/mm$^2$ or more and a high absorbed energy when deformed by bending.

2. Description of the Related Art

Conventionally, articles press formed from a high tension steel sheet are used as an automobile body reinforcement such as an impact beam for improving the car body strength against a side collision while minimizing any increase in the car body weight.

It is further desired to provide a material and a shape ensuring a high tensile and bending strength under a larger scale plastic deformation.

Japanese Examined Patent Publication (Kokoku) No. 56-46538 discloses a process for producing a high strength steel pipe, particularly a high tension electric welded steel pipe, in which a tempering treatment is used to ensure the ductility, as usually carried out when required to recover the toughness and the ductility.

The strength, however, is significantly reduced when the tempering is carried out at a high temperature required to improve the toughness and ductility, and it has been difficult to provide, for example, a steel pipe having a high strength of 120 kgf/mm$^2$ or more.

SUMMARY OF THE INVENTION

The object of the present invention is to provide an automobile body reinforcing steel pipe, such as an impact beam, which exhibits a high bending and tensile strength under a large scale deformation, to thus effectively absorb the car collision energy before a large scale deformation occurs and which provides a lightweight car body without a reduction of the energy absorbing ability.

To achieve the object according to the present invention, there is provided an automobile body reinforcing steel pipe having a wall thickness-to-outer diameter ratio, t/D, defined by the following formula;

$$0.09-4.8\times10^{-5}\times L\leqq t/D\leqq 0.16-6.0\times10^{-5}\times L$$

where L(mm) is a span of a bending load applied to the pipe.

A steel pipe according to the present invention preferably has a tensile strength of 120 kgf/mm$^2$ or more, and an elongation of 10% or more.

A steel pipe according to one aspect of the present invention is made of a steel consisting of:

C in an amount of from 0.15 to 0.25;

Mn in an amount sufficient to prevent a self-tempering during quench hardening of the steel but not more than 1.8 wt %;

Si in an amount sufficient to obtain a sound weld-bonding of the pipe but not more than 0.5 wt %;

Ti in an amount sufficient to fix N in steel, so that B effectively improves the steel hardenability, but not more than 0.04 wt %;

B in an amount of from 0.0003 to 0.0035 wt %; and the balance of Fe and unavoidable impurities including N in a minimum amount of not more than 0.0080 wt %.

A steel pipe according to another aspect of the present invention is made of a steel consisting of:

C in an amount of from 0.15 to 0.25;

Mn in an amount sufficient to prevent a self-tempering during quench hardening of the steel but not more than 1.8 wt %;

one or more elements selected from the group consisting of Ni, Cr and Mo, respectively, in an amount sufficient to promote the self-tempering prevention by Mn, but not more than 0.5 wt %;

Si in an amount sufficient to obtain a sound weld-bonding of the pipe, but not more than 0.5 wt %;

Ti in an amount sufficient to fix N in steel, so that B effectively improves the steel hardenability, but not more than 0.04 wt %;

B in an amount of from 0.0003 to 0.0035 wt %; and the balance of Fe and unavoidable impurities including N in a minimum amount of not more than 0.0080 wt %.

According to the present invention, there is also provided a process for producing an automobile body reinforcing steel pipe having a wall thickness-to-outer diameter ratio, t/D, defined by the following formula;

$$0.09-4.8\times10^{-5}\times L\leqq t/D\leqq 0.16-6.0\times10^{-5}\times L$$

where L(mm) is a span of a bending load applied to the pipe, the process comprising the steps of:

hot rolling to form a steel sheet from a steel consisting of;

C in an amount of from 0.15 to 0.25,

Mn in an amount sufficient to prevent a self-tempering during quench hardening of the steel but not more than 1.8 wt %, Si in an amount sufficient to obtain a sound weld-bonding of the pipe but not more than 0.5 wt %, Ti in an amount sufficient to fix N in steel, so that B effectively improves the steel hardenability, but not more than 0.04 wt %;

B in an amount of from 0.0003 to 0.0035 wt %, and the balance of Fe and unavoidable impurities, including N in a minimum amount of not more than 0.0080 wt %;

coiling the steel sheet in an as-hot-rolled state at a temperature of 600° C. or higher;

roll-forming the steel sheet to a pipe shape having adjacent edges;

electric welding the pipe shape at the adjacent edges to form an electric welded steel pipe; and quench hardening the steel pipe.

According to the present invention, there is also provided a process for producing an automobile body reinforcing steel pipe having a wall thickness-to-outer diameter ratio, t/D, defined by the following formula;

$$0.09-4.8\times10^{-5}\times L\leqq t/D\leqq 0.16-6.0\times10^{-5}\times L$$

where L(mm) is a span of a bending load applied to the pipe, the process comprising the steps of:

hot rolling to form a steel sheet from a steel consisting of:

C in an amount of from 0.15 to 0.25;

Mn in an amount sufficient to prevent a self-tempering during quench hardening of the steel but not more than 1.8 wt %;

one or more elements selected from the group consisting of Ni, Cr and Mo, respectively, in an amount sufficient to promote the self-tempering prevention by Mn, but not more than 0.5 wt %;

Si in an amount sufficient to obtain a sound weld-bonding of the pipe but not more than 0.5 wt %;

Ti in an amount sufficient to fix N in steel, so that B effectively improves the steel hardenability, but not more than 0.04 wt %;

B in an amount of from 0.0003 to 0.0035 wt %; and the balance of Fe and unavoidable impurities including N in a minimum amount of not more than 0.0080 wt %;

coiling the steel sheet in an as-hot rolled state at a temperature of 600° C. or higher;

roll forming the steel sheet to a pipe shape having adjacent edges;

electric welding the pipe shape at the adjacent edges to form an electric welded steel pipe; and quench hardening the steel pipe.

In an embodiment of a process according to the present invention, the quench hardening is carried out by passing the steel pipe through an induction heating coil and then a water cooling ring, while revolving the steel pipe.

In another embodiment of a process according to the present invention, the quench hardening is continuously carried out by transferring the steel pipe through an induction heating coil and then a water cooling ring, while revolving the steel pipe.

DESCRIPTION OF THE PREFERRED EMBODIMENTS

An automobile body reinforcing steel pipe according to the present invention effectively absorbs the car collision energy while having a lightweight, by having the shape as specified with respect to a service condition. A steel pipe according to the present invention provides a lighter weight and a higher energy absorption by having a specified chemical composition ensuring a good elongation and toughness of an as-quench-hardened steel pipe.

The present invention specifies the pipe shape for the following reasons.

Under a load specified by the FMVSS regulation No. 214, a beam is subjected to a three point bending, in which a maximum moment is obtained at a site just below a loading device to induce a local deformation. In the deformation process, a pipe exhibits a maximum strength when the longitudinal deformation is locally concentrated, to cause a phenomenon called "submission", and the strength is then sharply decreased to a minimum value when a circumferential "buckling" occurs. A steel pipe can hold its shape stably against the circumferential buckling in a way such that it still exhibits a high strength for a significant period of time after the submission occurs by being continuously deformed to an oval section, which is not the case for a square section member. Namely, a steel pipe does not easily buckle and does not cause a sharp reduction of strength, and thereby provides an effective shape of a member useful for impact beams which can be used under a large scale deformation.

It should be noted that the time at which the circumferential buckling occurs under a pressing-in displacement significantly varies with the wall thickness-to-outer diameter ratio, t/D, of the pipe. Therefore, the energy absorbed until a large scale deformation occurs varies largely in accordance with the t/D value. The energy absorption is also affected by the bending span.

Figure 1:
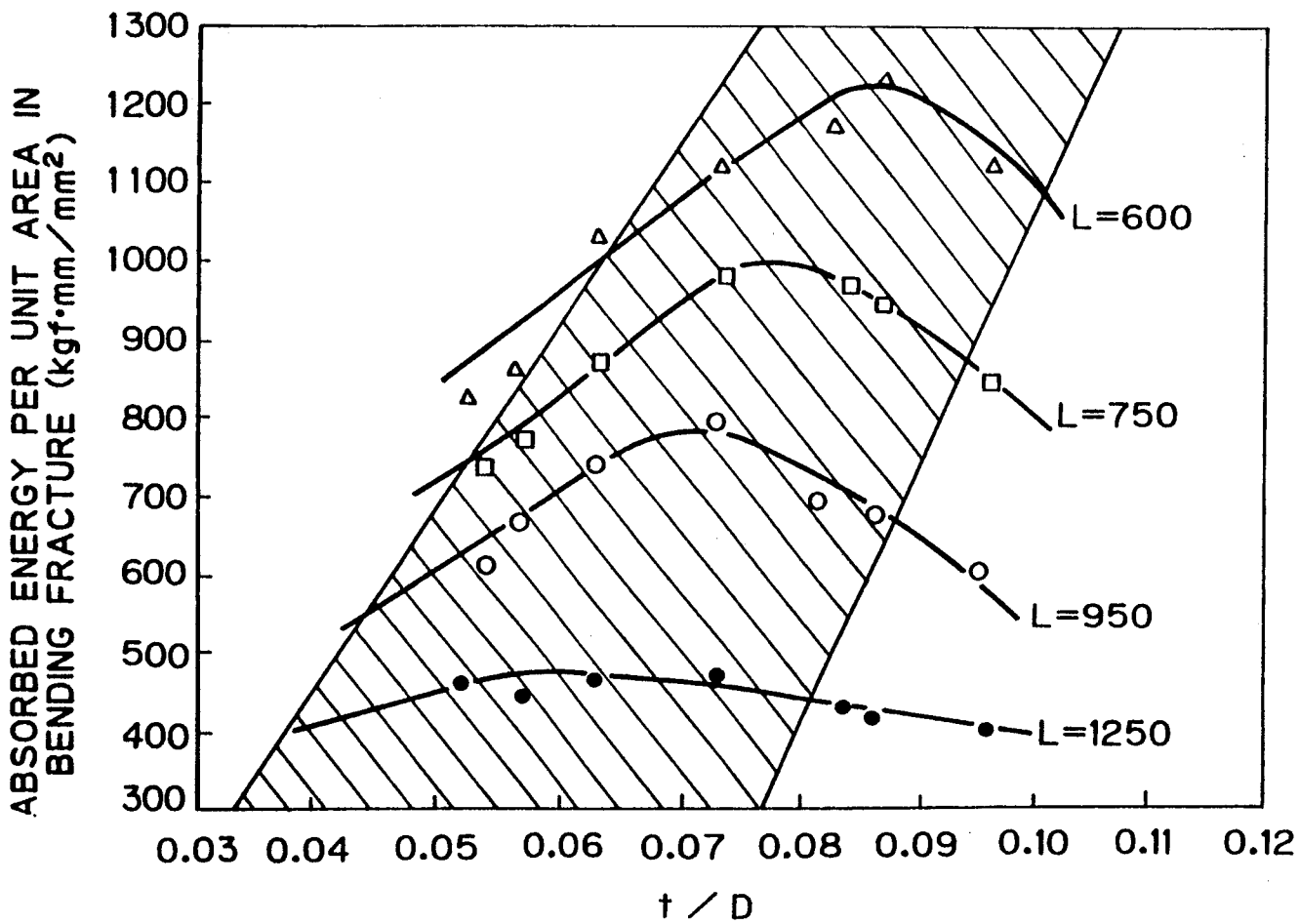
FIG. 1 shows a shape range for effectively improving the absorbed energy while providing a lightweight body.

FIG. 1 shows the absorbed energy as a function of the t/D value; these results were obtained by a study carried out by the present inventors. The absorbed energy is expressed as a load integrated by a bending displacement of 150 mm, assuming that the door inside must be deformed by 150 mm to reach the driver's body. FIG. 1 provides a wall thickness-to-outer diameter ratio for effectively increasing the absorbed energy while providing a lightweight, when the shown absorbed data are normalized with respect to the body part weight. The axis of ordinate indicates the absorbed energy divided by a sectional area, which provides an index corresponding to a value obtained by normalizing the absorbed energy with respect to the body part weight. The axis of abscissas indicates the wall thickness-to-outer diameter ratio. The characteristic curves are shown for various bending spans, L, assuming that a reinforcing steel pipe may be used at various fixed intervals in accordance with the automobile type or design. Under each span, the curves are maximized, and therefore, a too large t/D value does not effectively improve the absorbed energy but merely causes an increase of the weight. On the other hand, a too small t/D value leads to the occurrence of a sharp reduction of the bending reaction force due to the circumferential buckling under a small bending displacement, and does not provide an absorbed energy expected from the weight. According to the present invention, the hatched region provides an effective improvement of the absorbed energy and lightweight parts. When the span L is small, the hatched region shifts towards the large t/D value side. This shows that, when the span is small, the bending angle of an impact beam is large and the absorbed energy is remarkably reduced by the occurrence of buckling, and to avoid this, relatively larger t/D values are more effective than in the case of longer spans. The hatched region providing the pipe shape in terms of t/D effective for reinforcing the automobile body can be approximately defined by the following formula;

$$0.09-4.8\times10^{-5}\times L(mm)\leqq t/D\leqq 0.16-6.0\times10^{-5}\times L(mm).$$

When the span is large. the bending moment is actually small and the absolute value of the absorbed energy is extremely small even in the hatched region. To achieve a high absorbed energy while providing a lightweight, however, it is preferred not to increase the wall thickness of a pipe but to either reduce the span or use a plurality of steel pipes having shapes falling within the hatched region.

A further increase of the absorbed energy can be achieved by improving the material property of a steel pipe together with the above-described optimization of the pipe shape. The higher strength of the pipe material has an advantage in that the maximum bending load is increased in proportion to the increase of the material strength and the absorbed energy is also increased in proportion to the material strength. A tensile strength of 120 kgf/mm$^2$ or more, which can be industrially stably obtained, is advantageously used to simultaneously achieve both a lightweight and a high absorbed energy. An excessively high strength, however, significantly reduces the elongation. In a steel pipe used under a large scale plastic deformation, such as an impact beam, a local deformation strain of about 7% is sometimes observed, and therefore, the pipe material must have a total elongation of about 10% or more.

The chemical composition of the steel pipe according to the present invention should be determined by considering the tensile strength of 120 kgf/mm$^2$ or more for ensuring a lightweight, the elongation for a large scale deformation, and the toughness against occasional use under cryogenic conditions.

Figure 2:
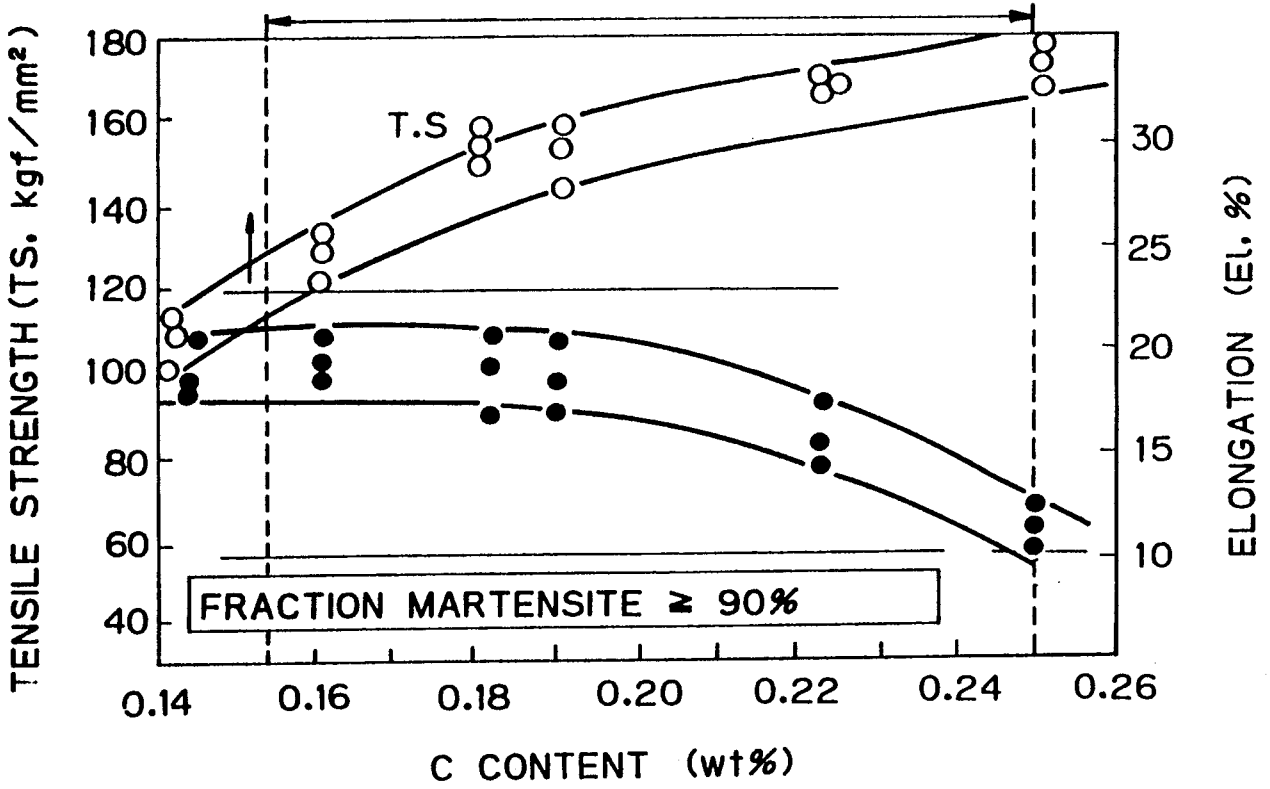
FIG. 2 shows the influence of the carbon content of steel on the tensile property of a quench hardened final product steel pipe.
Figure 3:
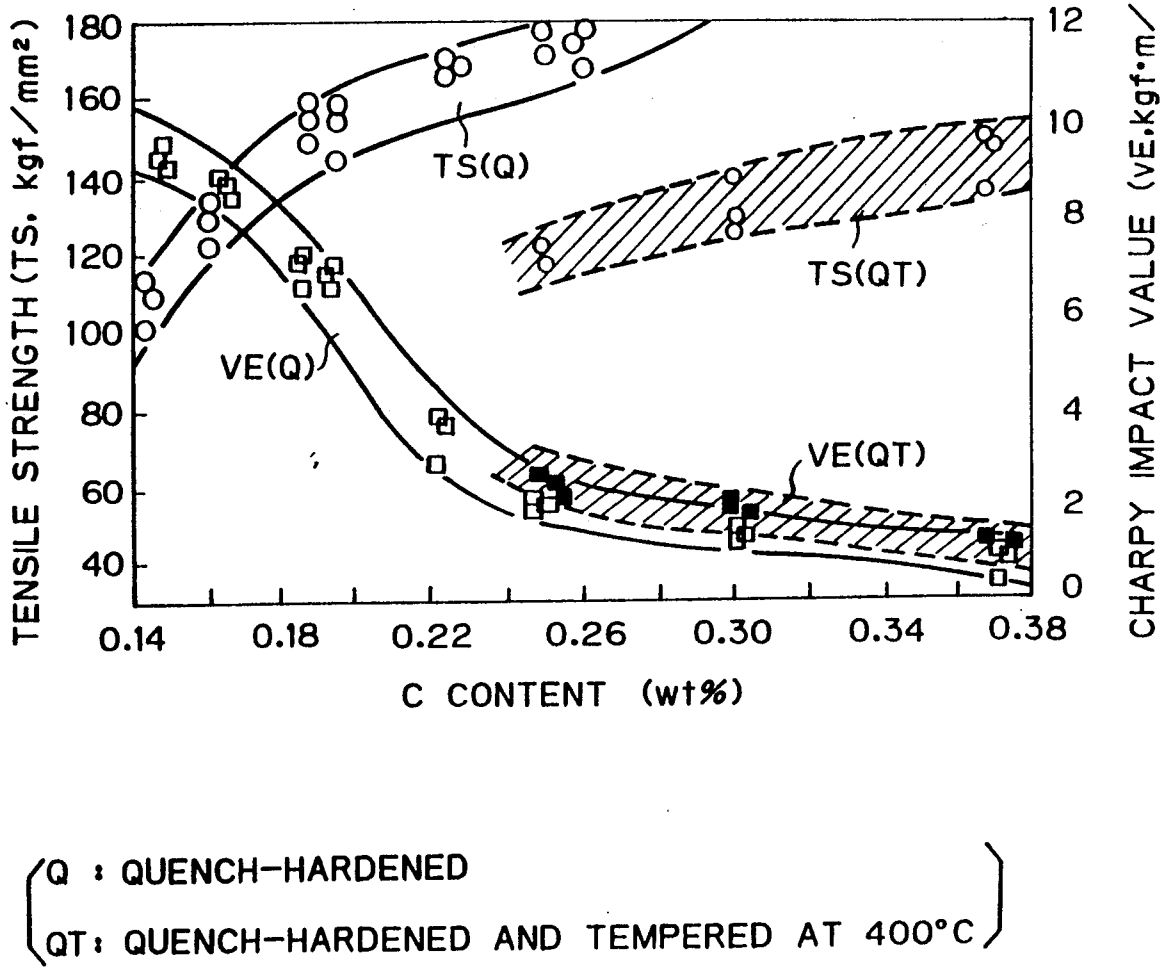
FIG. 3 shows the influence of the carbon content of steel on the tensile strength and the Charpy impact value of a quench hardened final product steel pipe, together with comparative data for steel pipes quench hardened and then tempered.

The present invention specifies the chemical composition of the pipe material in the sense that the final product as an automobile body reinforcing steel pipe is strengthened by an as-quenched hardened martensitic microstructure. The strength of an as-quench hardened martensite is determined by the C content, i.e., the supersaturated solute carbon introduced by an austenite-to-martensite transformation. The present inventors carried out a detailed study on the C content for ensuring a strength of 120 kgf/mm$^2$ or more with a fraction martensite structure of 90% or more and found that the C content must be 0.15 wt % or more, as shown in FIG. 2. When the C content is too high, the elongation is remarkably reduced, and thus the C content must not be more than 0.25 wt % to ensure an elongation of about 10% or more. FIG. 3 shows the toughness of the as-quench hardened material as a function of the C content, from which it is seen that the toughness if also high when the C content is 0.25 wt % or less.

As shown by the solid plots or the hatched region of FIG. 3, Japanese Examined Patent Publication (Kokoku) No. 56-46538 discloses an improvement of the toughness by tempering steels having higher C contents while minimizing the reduction of the strength, but the tempering does not provide the improvement of toughness achieved by the present inventive low carbon steel.

The tempering of a quench hardened material conventionally carried out, as seen in Japanese Examined Patent Publication (Kokoku) No. 56-46538, is used to ensure the elongation, in which the solute carbon coalesces to form a carbide precipitate. The tempered material is strengthened by a precipitation strengthening mechanism, not by a solution strengthening mechanism, and thus the strengthening mechanism is quite different from the present invention, in which tempering is not carried out and the material is strengthened by a solution strengthening mechanism.

As described above, the present invention specifies the C content of from 0.15 to 0.25 wt %, to achieve a high strength, toughness and elongation of an as-quench hardened material having superior properties when used as an automobile body reinforcing steel pipe.

Manganese, Mn, lowers the martensitic transformation temperature of a steel, improves the hardenability upon quench hardening treatment, prevents a post transformation self-tempering during the quench hardening treatment, and ensures a high strength. Therefore, Mn should be present in steel in an amount sufficient to ensure these characteristic effects. The Mn content, however, must not be more than 1.8 wt %, to prevent welding defects which would otherwise occur during an electric welding for producing a steel pipe, for example.

Nickel (Ni), chromium (Cr), and molybdenum (Mo), when added to steel together with Mn, lower the martensitic transformation temperature, prevent self-tempering, and further increase the strength, although these elements are much more expensive than Mn. To ensure a good weldability, the upper limit of the contents of these elements are 0.5 wt %.

Silicon (Si) is as important as Mn, to obtain a sound welded joint when manufacturing a steel pipe by electric welding. Namely, Si must be present in an amount sufficient to obtain a sound weld-bonding. The upper limit of the Si content is 0.5 wt % and the content ratio Mn/Si is preferably from 3 to 10, to prevent a formation of an oxide, called a "penetrater", in the welded joint.

Boron (B) remarkably improves the hardenability and is added to the present inventive steel to ensure a fraction martensite structure of 90% or more with a relatively low carbon content. To obtain the hardenability improving effect, B must be present in an amount of 0.0003 wt % or more but not more than 0.0035 wt %, because an excessive amount of B not only causes a surface defect and a reduction of toughness but also raises costs. Therefore, the B content must be within the range of from 0.0003 wt % to 0.0035 wt %.

As the hardenability improving effect of B is lost when nitrogen (N) is present in an amount of 0.003 wt % or more, titanium (Ti) is added to fix N. Namely, Ti must be present in an amount sufficient to fix N in steel, so that B effectively improves the steel hardenability. The Ti content must not be more than 0.04 wt %, to prevent a degradation of the product pipe quality, such as the occurrence of defects and an impairing of the machinability.

N is unavoidably present in steel to form BN and reduce the effect of B, and therefore, the N content should be made as low as possible; the upper limit of the N content is 0.0080 wt %.

The above-described pipe shape, and further, the pipe property and the chemical composition ensures that the steel pipe according to the present invention has a tensile strength of 120 kgf/mm$^2$ or more, a good ductility and toughness, and a high absorbed energy while ensuring a lightweight as an automobile body reinforcing steel pipe.

The process for producing a steel pipe according to the present invention uses a specified hot rolling condition; particularly, the coiling temperature.

Figure 4:
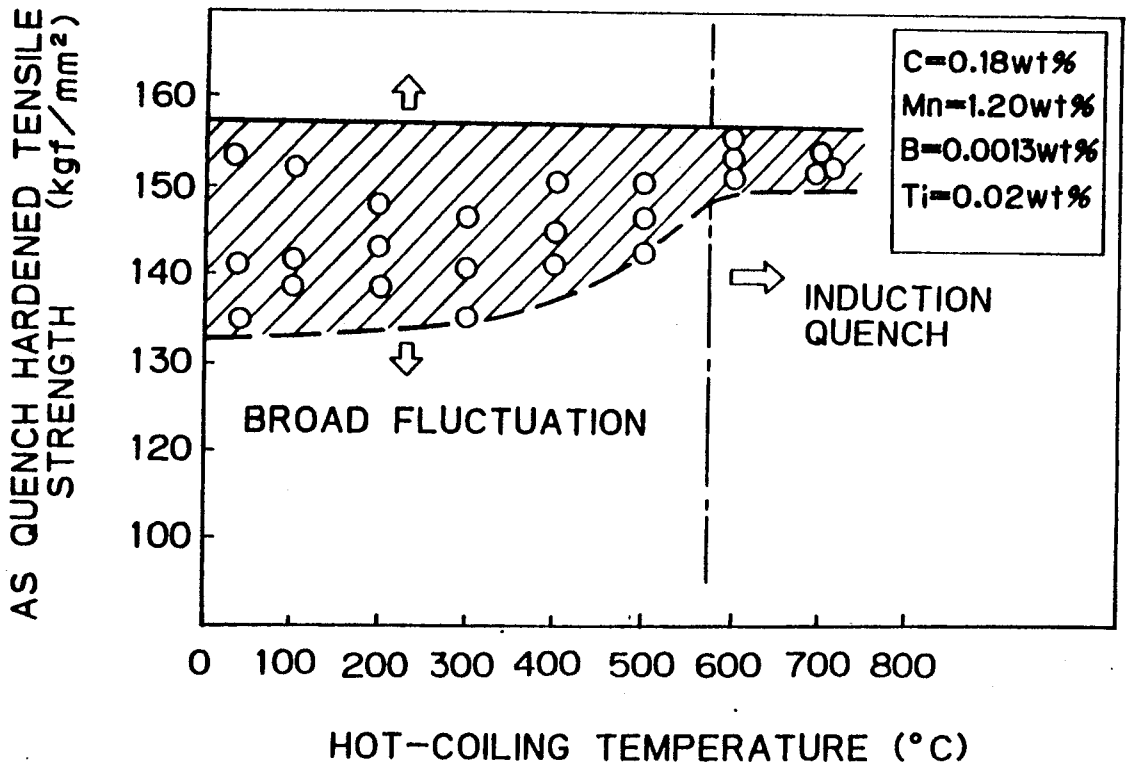
FIG. 4 shows the influence of the coiling temperature on the tensile strength of the quench hardened steel pipes.

FIG. 4 shows the relationship between the coiling temperature after hot rolling as indicated by the abscissa and the strength of steel pipes produced by electric welding a hot rolled sheet and then quench hardened, as indicated by the ordinate, in which a broad fluctuation of the strength is observed when the coiling temperature is lower than 600° C. The samples had the same chemical composition and were quench hardened under the same condition. Substantially the same strength is obtained regardless of the coiling temperature when the steel pipe is fully hardened, but with a coiling temperature lower than 600° C., an incompletely hardened structure is partially present to cause a fluctuation of the strength, and thus a high strength cannot be stably obtained.

Conversely, when the coiling temperature is 600° C. or higher, the hot rolled sheet has a relatively coarse ferrite-pearlite structure and a pipe formed of the sheet is completely quench hardened to provide a high strength without fluctuation.

The specified coiling temperature of 600° C. or higher is also required for successfully forming a steel pipe from a hot rolled sheet, i.e., a good pipe formability. The term "pipe formability" means that the hot rolled sheet is easy to handle, form, and electric weld.

The starting material of the present inventive process has a minimum C content but is supplemented with B, etc., to enhance the hardenability, and therefore, the strength of a hot rolled sheet is easily increased when the coiling is carried out at a low temperature. The high strength of a hot rolled sheet causes problems, including: a short service life of the cutting tool used for shearing the hot rolled sheet to a cut sheet to be electric welded to a pipe; a difficult handling due to increased coiling and uncoiling forces; a heavy reaction or back force during forming due to an increased yield strength of the material; a difficult shaping due to a large springback; a difficulty in forming; and a bad geometry of a power feeding portion for electric welding, causing an unstable quality of the welded joint.

Figure 5:
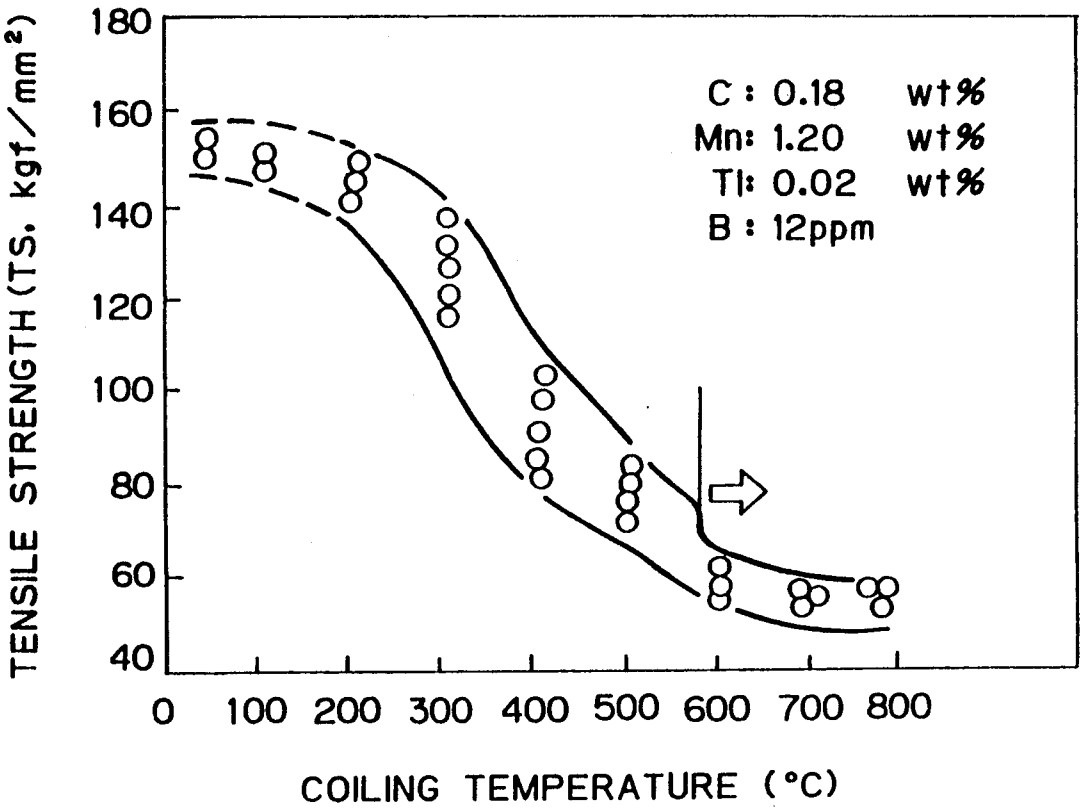
FIG. 5 shows the influence of the coiling temperature on the tensile strength of the hot rolled steel sheets.

As can be seen from FIG. 5, the coiling carried out at a temperature of 600° C. or higher provides a hot rolled sheet having a strength of 40 to 60 kgf/mm$^2$, which is the same level as those of general electric welded steel pipes, and therefore, an electric welding can be carried out under the same condition as in the case of general electric welded steel pipes.

The fluctuation of the material strength is another factor adversely affecting the pipe formability. A material prepared for producing an impact beam often has a small thickness and exhibits a relatively rapid cooling after hot rolling, with the result that a slight variation of the cooling condition significantly affects the coiling temperature, and when the coiling temperature becomes lower than 600° C., the material strength significantly varies corresponding to the variation of the coiling temperature to adversely affect the stable forming, and in turn, the electric welding of pipe. FIG. 4 shows that, when the coiling temperature is 600° C. or higher, the material strength does not significantly vary with the variation of the coiling temperature and a good pipe formability is ensured.

A hot rolled sheet having the specified chemical composition and produced under the specified hot rolling condition, i.e., the coiling temperature, can be easily made to an electric welded pipe which is then quench hardened to provide a tensile strength of 120 kgf/mm$^2$ or more and a superior ductility and toughness, i.e., a good performance of an automobile body reinforcing steel pipe.

The quench hardening treatment of the present invention is preferably carried out by an induction quench hardening, not by a conventional furnace heating and cooling, to prevent a coarsening of the austenite grains and the resulting adverse effect on the toughness, and to stably provide a fraction martensite structure of 90% or more. The conventional furnace hardening treatment involves a time interval from discharging a pipe from a furnace to quenching the pipe, and therefore, requires an extra high heating temperature, which unavoidably causes a coarsening of the austenite grains. Moreover, to ensure a straightness of the quench hardened pipe, a welded pipe must be cramped to be quenched uniformly, and thus complicated equipment must be provided at the discharge side of the furnace at the cost of productivity.

Figure 6:
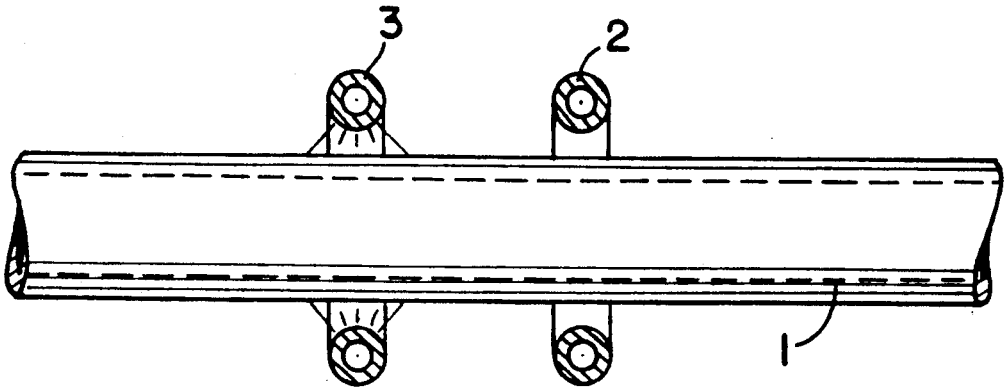
FIGS. 6 and 6A shows an arrangement for carrying out an induction quench hardening of a steel pipe.
Figure 6A:
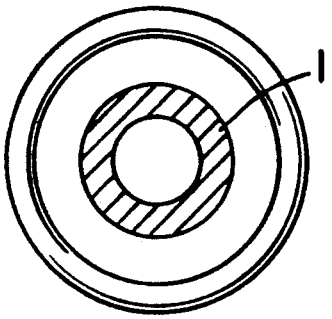

FIG. 6 shows an arrangement for induction quench hardening a steel pipe, in which heating and quenching are effected when a pipe passes through a compact heating coil and water cooling ring without an extra high temperature heating, and therefore, the toughness is improved due to a refinement of the austenite grains. The straightness of the quench hardened pipe is also achieved by revolving the pipe around the axis of a heating coil and water cooling ring so as to heat and quench the pipe uniformly along the pipe length.

The induction quench hardening of FIG. 6 may be practically carried out in either of the following two ways: a pipe travels along its length through a fixed induction heating coil and water cooling ring while being revolving; and a induction heating coil and water cooling ring travels along the pipe length to heat and quench the pipe only revolving around its axis, not moving axially.

Although both of these ways provide the same quality of quench hardened pipe, the former way in which a pipe travels can significantly improve the treatment capacity in comparison with the latter, because long and short pipes may be continuously treated. When an improved productivity is particularly desired, the induction quench hardening is carried out in the former way.

The heat treating arrangement of FIG. 6 has another advantage in that it can be extremely compact, i.e., requires only a space of about several times the outer diameter of a pipe to be quench hardened. This allows a plurality of such heat treatment units to be arranged in parallel, and equipment for charging, holding, transferring, and discharging pipes are mostly commonly used, to preferentially improve the heat treating capacity.

EXAMPLE

Table 1 summarizes the bending test data for samples having pipe shapes according to the present invention, together with those for comparative samples having pipe shapes outside the present inventive range. All of the samples have the same chemical composition as that of Sample P shown in Table 3.

Samples A to D have t/D values within the specified range of the present invention, Samples E, G, I, and K have t/D values greater than the specified range, and Samples F, H, J, and L have t/D values smaller than the specified range.

The absorbed energy is divided by the sectional area to provide an index value for evaluating samples. Samples are compared for the same span, to show that the present invention effectively improves the absorbed energy while ensuring a lightweight, as can be seen from the wall thickness data.

Table 2 shows the data for samples tested with the same large span, both having the same chemical composition as that of Sample P of Table 3 and the same outer diameter as usually determined by the restricted conditions of an actual car body in which the pipes are used.

In Sample M, two pipes according to the present invention are used to increase the absorbed energy, and in Comparative Sample N, one pipe having a t/D value greater than the specified range (a greater wall thickness t in this case) is used to provide the same absorbed energy as that provided by Sample M of the present invention. The result shows that Sample M of the present invention is about 30% lighter than Comparative Sample N.

Table 3 summarizes the strength, ductility and toughness data for samples having chemical compositions within or outside the specified range of the present invention.

Steel pipes having an outer diameter of 38.1 mm and a wall thickness of 2.0 mm were quench hardened by induction quench hardening treatment and some of the quench hardened pipes were tempered. The thus heat treated samples were subjected to a tensile test by using a JIS No. 11 test piece and a Charpy impact test by using a full size test piece prepared for special use in evaluating the toughness.

Samples O to U having chemical compositions within the specified range and quench hardened exhibited a tensile strength of 120 kgf/mm$^2$ or greater, an elongation of about 10% or greater, and an absorbed energy of 2 kgf-m/cm$^2$ or more.

Comparative Sample V having a C content lower than the specified range exhibited a poor strength lower than the intended level of 120 kgf/mm$^2$.

Comparative Sample W having a C content higher than the specified range achieved the intended strength but had a very poor elongation.

Comparative Samples X, Y and Z having a C content higher than the specified range like Sample W, were tempered after quench hardening to improve the ductility and toughness, but a high strength and a high ductility and toughness are not simultaneously achieved.

Table 4 summarizes the strength, ductility and toughness data for samples of hot rolled sheets and quench hardened pipes, the coiling of hot rolled sheets being carried out at temperatures within or outside the specified range of the present invention. A tensile test of the host rolled sheets was performed by using a JIS No. 4 test piece. The hot rolled sheets were electric welded to form a steel pipe having an outer diameter of 31.8 mm and a wall thickness of 2.0 mm, which were then quench hardened by induction quench hardening treatment. The samples from the quench hardened pipes were subjected to a tensile test by using a JIS No. 11 test piece and a Charpy impact test.

In Samples AA to AG according to the present invention, the host rolled sheets had a tensile strength of about 60 kgf/mm$^2$ and the formation of pipes was carried out without problem. The quench hardened pipes had a tensile strength of 120 kgf/mm$^2$ or greater, an elongation of 10% or greater, and an absorbed energy of 2 kgf-m/cm$^2$ or greater, with a small fluctuation of tensile strength of several kgf/mm$^2$ due to a uniform microstructure.

Comparative Samples AH to AL obtained from the hot rolled sheets coiled at temperatures lower than the specified lower limit of 600° C. The quench hardened pipes of these comparative samples exhibited a relatively high strength, ductility and toughness, but the tensile strength showed a broad fluctuation of up to 20 kgf/mm$^2$, which is not acceptable for an automobile body reinforcing steel pipe. Moreover, the hot rolled sheets had a high strength and caused a poor pipe formability.

Comparative Samples AH, AJ, and AK require a special measure in the manufacture of electric welded pipes to prevent a cutting wheel from damage when shearing the hot rolled sheets, and ensure a good shearing quality.

In Comparative Samples AI and AL, the hot rolled sheets had a reduced strength providing a relatively good shearing quality, although a problem of the service life of the cutting wheel still remained. Another problem existed in that the handling of the top and end edges of hot rolled sheet was difficult and a heavy reaction or back force when forming a pipe necessitated an additional adjustment step, which significantly reduced the productivity.

As described herein, the present invention specifies the pipe shape or the t/D ratio to improve the absorbed energy while ensuring a lightweight, to enhance safety during a car collision.

The absorbed energy is further improved by additionally specifying the mechanical property and/or the chemical composition of the pipe.

The present invention also provides a process for producing an automobile body reinforcing steel pipe having a high strength at a high productivity and at the same processing load as required for the conventional low strength steel pipe.

TABLE 1

| Sample | OD(D) (mm) | WT(t) (mm) | t/D | Span(L) (mm) | AE/A (kgf-mm/mm$^2$) |
|---|---|---|---|---|---|
| Invention | | | | | |
| A | 31.8 | 1.8 | 0.056 | 1250 | 440 |
| B | 31.8 | 2.0 | 0.063 | 950 | 720 |
| C | 31.8 | 2.4 | 0.075 | 750 | 1000 |
| D | 31.8 | 2.8 | 0.088 | 600 | 1200 |
| Comparison | | | | | |
| E | 31.8 | 3.2 | 0.100 | 1250 | 400 |
| F | 31.8 | 1.0 | 0.031 | 1250 | 390 |
| G | 31.8 | 3.2 | 0.100 | 950 | 590 |
| H | 31.8 | 1.2 | 0.038 | 950 | 510 |
| I | 31.8 | 3.5 | 0.110 | 750 | 790 |
| J | 31.8 | 1.4 | 0.044 | 750 | 690 |
| K | 31.8 | 3.5 | 0.110 | 600 | 950 |
| L | 31.8 | 1.6 | 0.050 | 600 | 900 |

[Note]
OD: Outer diameter
WT: Wall thickness
AE/E: Absorbed energy per unit area

TABLE 2

| Sample | OD(D) (mm) | WT(t) (mm) | Span(L) (mm) | Number of pipes | AE (kgf-m) | Weight (kg) |
|---|---|---|---|---|---|---|
| Invention | | | | | | |
| M | 31.8 | 2.0 | 1250 | 2 | 176.0 | 3.68 |
| Comparison | | | | | | |
| N | 31.8 | 6.0 | 1250 | 1 | 179.0 | 4.78 |

[Note]
OD: Outer diameter
WT: Wall thickness
AE: Absorbed energy

TABLE 3

| Sample | Chemical composition (wt %) C | Si | Mn | P | S | Ti | B | N | Al | Ni | Cr | Mo | TT (°C.) | TS (kgf/mm²) | YS (kgf/mm²) | El (%) | vE $_{-20}$ (kgf-m/cm²) |
|---|---|---|---|---|---|---|---|---|---|---|---|---|---|---|---|---|---|
| Invention | | | | | | | | | | | | | | | | | |
| O | 0.16 | 0.18 | 1.12 | 0.018 | 0.004 | 0.022 | 0.0011 | 0.0051 | 0.026 | — | 0.22 | — | — | 135.2 | 102.5 | 17.0 | 7.9 |
| P | 0.18 | 0.20 | 1.15 | 0.016 | 0.003 | 0.021 | 0.0012 | 0.0053 | 0.024 | — | 0.23 | — | — | 158.0 | 115.0 | 16.0 | 5.9 |
| Q | 0.22 | 0.21 | 1.18 | 0.018 | 0.004 | 0.021 | 0.0011 | 0.0045 | 0.028 | — | 0.22 | — | — | 163.2 | 122.5 | 13.0 | 4.0 |
| R | 0.18 | 0.20 | 1.15 | 0.016 | 0.003 | 0.021 | 0.0012 | 0.0053 | 0.024 | 0.50 | 0.20 | 0.2 | — | 159.0 | 112.0 | 17.0 | 6.9 |
| S | 0.18 | 0.20 | 1.15 | 0.016 | 0.004 | 0.021 | 0.0012 | 0.0053 | 0.024 | — | 0.40 | 0.2 | — | 158.5 | 114.0 | 16.0 | 5.7 |
| T | 0.18 | 0.20 | 1.15 | 0.016 | 0.003 | 0.021 | 0.0012 | 0.0053 | 0.024 | 0.50 | — | — | — | 155.0 | 109.0 | 18.0 | 7.1 |
| U | 0.18 | 0.20 | 1.15 | 0.016 | 0.003 | 0.021 | 0.0012 | 0.0053 | 0.024 | — | — | — | — | 156.0 | 110.0 | 16.0 | 6.2 |
| Comparison | | | | | | | | | | | | | | | | | |
| V | 0.14 | 0.19 | 1.13 | 0.017 | 0.004 | 0.022 | 0.0011 | 0.0051 | 0.026 | — | 0.22 | — | — | 110.5 | 90.2 | 19.0 | 8.3 |
| W | 0.26 | 0.21 | 1.18 | 0.018 | 0.004 | 0.021 | 0.0011 | 0.0045 | 0.028 | — | 0.22 | — | — | 172.2 | 130.5 | 7.0 | 1.5 |
| X | 0.25 | 0.21 | 1.16 | 0.016 | 0.003 | 0.026 | 0.0012 | 0.0048 | 0.021 | — | — | — | 300 | 147.2 | 134.0 | 6.0 | 1.8 |
| Y | 0.25 | 0.21 | 1.16 | 0.016 | 0.003 | 0.026 | 0.0012 | 0.0048 | 0.021 | — | — | — | 400 | 114.3 | 107.6 | 7.0 | 1.6 |
| Z | 0.25 | 0.21 | 1.16 | 0.016 | 0.003 | 0.026 | 0.0012 | 0.0048 | 0.021 | — | — | — | 500 | 95.0 | 86.2 | 8.0 | 2.9 |

[Note]
TT: Tempering temperature
TS: Tensile strength
YS: Yield strength
El: Elongation
vE $_{-20}$: Absorbed energy in Charpy impact test at −20° C.

TABLE 4

| Sample | Chemical composition (wt %) C | Si | Mn | P | S | Ti | B | N | Al | Ni | Cr | Mo |
|---|---|---|---|---|---|---|---|---|---|---|---|---|
| Invention | | | | | | | | | | | | |
| AA | 0.16 | 0.18 | 1.12 | 0.018 | 0.004 | 0.022 | 0.0011 | 0.0051 | 0.026 | — | 0.22 | — |
| AB | 0.18 | 0.20 | 1.15 | 0.016 | 0.003 | 0.021 | 0.0012 | 0.0053 | 0.024 | — | 0.23 | — |
| AC | 0.22 | 0.21 | 1.18 | 0.018 | 0.004 | 0.021 | 0.0011 | 0.0045 | 0.028 | — | 0.22 | — |
| AD | 0.18 | 0.20 | 1.15 | 0.016 | 0.003 | 0.021 | 0.0012 | 0.0053 | 0.024 | 0.50 | 0.20 | 0.2 |
| AE | 0.18 | 0.20 | 1.15 | 0.016 | 0.004 | 0.021 | 0.0012 | 0.0053 | 0.024 | — | 0.40 | 0.2 |
| AF | 0.18 | 0.20 | 1.15 | 0.016 | 0.003 | 0.021 | 0.0012 | 0.0053 | 0.024 | 0.50 | — | — |
| AG | 0.18 | 0.20 | 1.15 | 0.016 | 0.003 | 0.021 | 0.0012 | 0.0053 | 0.024 | — | — | — |
| Comparison | | | | | | | | | | | | |
| AH | 0.22 | 0.20 | 1.15 | 0.016 | 0.003 | 0.021 | 0.0012 | 0.0053 | 0.024 | — | 0.23 | — |
| AI | 0.21 | 0.21 | 1.16 | 0.016 | 0.003 | 0.026 | 0.0012 | 0.0048 | 0.021 | — | — | — |
| AJ | 0.18 | 0.21 | 1.16 | 0.016 | 0.003 | 0.026 | 0.0012 | 0.0048 | 0.021 | — | — | — |
| AK | 0.18 | 0.21 | 1.16 | 0.016 | 0.003 | 0.026 | 0.0012 | 0.0048 | 0.021 | — | — | — |
| AL | 0.18 | 0.21 | 1.16 | 0.016 | 0.003 | 0.026 | 0.0012 | 0.0048 | 0.021 | — | — | — |

| Sample | Hot rolled sheet CT (°C.) | TS (kgf/mm²) | PF | Electric welded pipe ΔTS (n = 5) | TS (kgf/mm²) | YS (kgf/mm²) | El (%) | vE $_{-20}$ (kgf m/cm²) |
|---|---|---|---|---|---|---|---|---|
| Invention | | | | | | | | |
| AA | 620 | 52.0 | a | 6.2 | 135.2 | 102.5 | 17.0 | 7.9 |
| AB | 620 | 53.0 | a | 4.3 | 158.0 | 115.0 | 16.0 | 5.9 |
| AC | 650 | 58.0 | a | 5.2 | 163.2 | 122.5 | 13.0 | 4.0 |
| AD | 620 | 55.0 | a | 3.7 | 159.0 | 112.0 | 17.0 | 6.9 |
| AE | 650 | 59.0 | a | 4.5 | 158.5 | 114.0 | 16.0 | 5.7 |
| AF | 650 | 55.0 | a | 2.2 | 155.0 | 109.0 | 18.0 | 7.1 |
| AG | 620 | 54.0 | a | 4.5 | 156.0 | 110.0 | 16.0 | 6.2 |
| Comparison | | | | | | | | |
| AH | 200 | 142.0 | c | 19.5 | 158.0 | 121.0 | 11.0 | 3.3 |
| AI | 400 | 95.0 | b | 21.0 | 150.1 | 123.3 | 11.5 | 3.2 |
| AJ | 30 | 140.0 | c | 23.5 | 143.5 | 109.5 | 11.5 | 4.9 |
| AK | 200 | 139.0 | c | 21.5 | 142.2 | 107.2 | 11.0 | 4.0 |
| AL | 400 | 95.0 | b | 18.0 | 149.5 | 105.5 | 12.0 | 2.7 |

[Note]
CT: Coiling temperature
PF: Pipe formability (a: good, b: poor but less trouble, c: poor)
ΔTS: Fluctuation of tensile strength (Max.TS−Min.TS)
TS: Tensile strength
YS: Yield strength
El: Elongation
vE $_{-20}$: Absorbed energy in Charpy impact test at −20° C.

We claim:

1. An automobile body reinforcing steel pipe having a wall thickness-to-outer diameter ratio, t/D, defined by the following formula;

$$0.09-4.8\times10^{-5}\times L \leqq t/D \leqq 0.16-6.0\times10^{-5}\times L$$

where L(mm) is a span of a bending load applied to the pipe.

2. An automobile body reinforcing steel pipe according to claim 1, wherein said steel pipe has a tensile strength of 120 kgf/mm² or more and an elongation of 10% or more.

3. An automobile body reinforcing steel pipe according to claim 1, wherein said pipe is made of a steel consisting of:

C in an amount of from 0.15 to 0.25;

Mn in an amount sufficient to prevent a self-tempering during quench hardening of said steel, but not more than 1.8 wt %;

Si in an amount sufficient to obtain a sound weld-bonding of said pipe, but not more than 0.5 wt %;

Ti in an amount sufficient to fix N in steel, so that B effectively improves the steel hardenability, but not more than 0.04 wt %;

B in an amount of from 0.0003 to 0.0035 wt %; and the balance of Fe and unavoidable impurities including N in a minimum amount of not more than 0.0080 wt %.

4. An automobile body reinforcing steel pipe according to claim 1, wherein said pipe is made of a steel consisting of:

C in an amount of from 0.15 to 0.25;

Mn in an amount sufficient to prevent a self-tempering during quench hardening of said steel, but not more than 1.8 wt %;

one or more elements selected from the group consisting of Ni, Cr and Mo, respectively, in an amount sufficient to promote said self-tempering prevention by Mn, but not more than 0.5 wt %;

Si in an amount sufficient to obtain a sound weld-bonding of said pipe, but not more than 0.5 wt %;

Ti in an amount sufficient to fix N in steel so that B effectively improves the steel hardenability, but not more than 0.04 wt %;

B in an amount of from 0.003 to 0.0035 wt %; and the balance of Fe and unavoidable impurities including N in a minimum amount of not more than 0.0080 wt %.

* * * * *